United States Patent [19]

Wootton

[11] 4,288,651

[45] Sep. 8, 1981

[54] DIELECTRIC GAS SELECTED FROM BINARY MIXTURES OF $SF_6$, $SO_2$ AND $CF_3CFCF_2$

[75] Inventor: Roy E. Wootton, Murrysville, Pa.

[73] Assignee: Electric Power Research Institute, Inc., Palo Alto, Calif.

[21] Appl. No.: 100,839

[22] Filed: Dec. 6, 1979

[51] Int. Cl.[3] ..... H01B 3/56

[52] U.S. Cl. ..... 174/17 GF; 174/25 G; 174/31 R; 252/571

[58] Field of Search ..... 252/66, 63.5, 571; 174/17 GF, 25 G, 31 R; 200/149 R, 149 A, 148 G, 144 C, 144 R

[56] References Cited

U.S. PATENT DOCUMENTS 2,867,679 1/1959 Cobine ..... 252/66 X
4,175,048 11/1979 Christophorou et al. ..... 252/66 X

FOREIGN PATENT DOCUMENTS 1540271 11/1970 Fed. Rep. of Germany ..... 252/66
904125 8/1962 United Kingdom ..... 200/150

*Primary Examiner*—Harris A. Pitlick
*Attorney, Agent, or Firm*—Flehr, Hohbach, Test, Albritton & Herbert

[57] ABSTRACT

Dielectric gas mixture including a binary pair of gases with electric strengths in uniform or quasi-uniform fields which are higher than that for either component of the gases alone. Such binary pairs include (a) $SF_6$ and $CF_3CFCF_2$, (b) $SO_2$ and $CF_3CFCF_2$, and (c) $SO_2$ and $SF_6$.

8 Claims, 3 Drawing Figures

$SF_6 + SO_2$
BREAKDOWN VOLTAGE (kV PEAK, 60 Hz)
(kV rms, 60 Hz)
90
80
70
60
50
30
20
10
0
100
50
$SF_6$ IN MIXTURE (%)
0 10 25 50 75
100 90 75 50 25
$SO_2$ IN MIXTURE (%)

$SO_2 + CF_3CFCF_2$
BREAKDOWN VOLTAGE (kV PEAK, 60 Hz)
(kV rms, 60 Hz)
80
70
60
40
30
20
10
0
100
50
$SO_2$ IN MIXTURE (%)
0 25 50 75 100
100 75 50 25 0
$CF_3CFCF_2$ IN MIXTURE (%)

DIELECTRIC GAS SELECTED FROM BINARY MIXTURES OF $SF_6$, $SO_2$ AND $CF_3CFCF_2$

CROSS-REFERENCE TO RELATED APPLICATIONS

Reference is made to a patent application entitled Dielectric Gas Mixture, Ser. No. 72,344, filed Sept. 4, 1979.

BACKGROUND OF THE INVENTION

The present invention relates to a dielectric gas mixture for use in electrically insulating a conductor.

When high voltages exist between the conductors of electrical apparatus (e.g., transformers, circuit breakers, or switches), arcing or sparking may take place. To prevent this phenomenon, dielectric fluids (gas or liquid) or solids are conventionally used to insulate the conductors.

One well-known dielectric gas is sulfur hexafluoride ($SF_6$). While possessing good arc interrupting properties it is relatively expensive and suffers from relatively low vapor pressure at low temperatures and a comparatively high freezing point. Many dielectric gas mixtures have been suggested, such as illustrated in Mears et al. U.S. Pat. No. 4,071,461.

Efforts have been made to improve the cost-effectiveness of circulating $SF_6$ gas in power transmission lines and substations by diluting the $SF_6$ with nitrogen. Such dilution has been found to result in a substantial cost reduction but with a small reduction in the uniform-field electric strength. This reduction in electric strength is consistent with a linear addition of the net ionization and attachment coefficients of the two gases. This rule or formula was proposed first by A. Wieland, ETZ-A, 94 (1973), pages 370–373. A similar, but less marked effect, occurs with $SF_6$ and He. This assumption that ionization and attachment coefficients add linearly in gas mixtures had been assumed to be accurate by authors in the field.

SUMMARY OF THE INVENTION AND OBJECTS

It is an object of the invention to provide novel dielectric gas mixtures with improved properties in comparison to conventional ones. It is a particular object of the invention to provide binary gas mixtures with electric strengths which are higher than that of the component gases alone. Further objects and features of the invention will be apparent from the following description taken in conjunction with the accompanying drawing.

In accordance with the above objects, three different binary gas mixtures are provided, with the unique property of electrical strengths in uniform or quasi-uniform fields higher than those of either the component gasses. Such binary gas mixtures include the following: (a) $SF_6$ and $CF_3CFCF_2$, (b) $SO_2$ and $CF_3CFCF_2$, and (c) $SO_2$ and $SF_6$. Typical mixtures include at least 25% of each component of the binary mixture. (Unless otherwise specified, percentages herein are on a molar basis.)

DETAILED DESCRIPTION OF THE PREFERRED EMBODIMENTS

Dielectric gas mixture of the present invention is intended for use in any high voltage gas-filled electrical apparatus such as circuit-interrupting apparatus, transformer apparatus, coaxial lines, or the like. The dielectric gas mixture may be used on the exterior or interior of a conductor and such apparatus is particularly useful where high voltages exist between conductors where arcing, sparking and/or discharges may occur. The gas is sealed in the equipment, such as in a gas-filled terminal bushing. A suitable terminal bushing construction in which the dielectric gas of the present invention may be utilized can be found in Friedrich et al. U.S. Pat. No. 3,059,044.

The present dielectric gas mixture is intended for use adjacent to the conductor in the above type of electrical apparatus while the conductor carries an electric current in which there is a tendency to arc or spark during voltage surges.

The invention specifically revolves around binary gas mixtures with electric strengths in uniform or quasi-uniform fields which are higher than that for either of the component gases alone. The following binary pairs have unexpectedly been found to function in this synergistic way: (a) $SF_6$ and $CF_3CFCF_2$, (b) $SO_2$ and $CF_3CFCF_2$, and (c) $SO_2$ and $SF_6$.

It has unexpectedly been found that the foregoing three gas pairs do not obey the Wieland formula in that they exhibit breakdown strengths in uniform electric fields which are higher than those of either component. This is particularly significant in that the foregoing gas mixtures provide exceptional dielectric strength properties for use in the foregoing applications.

Figure 1:
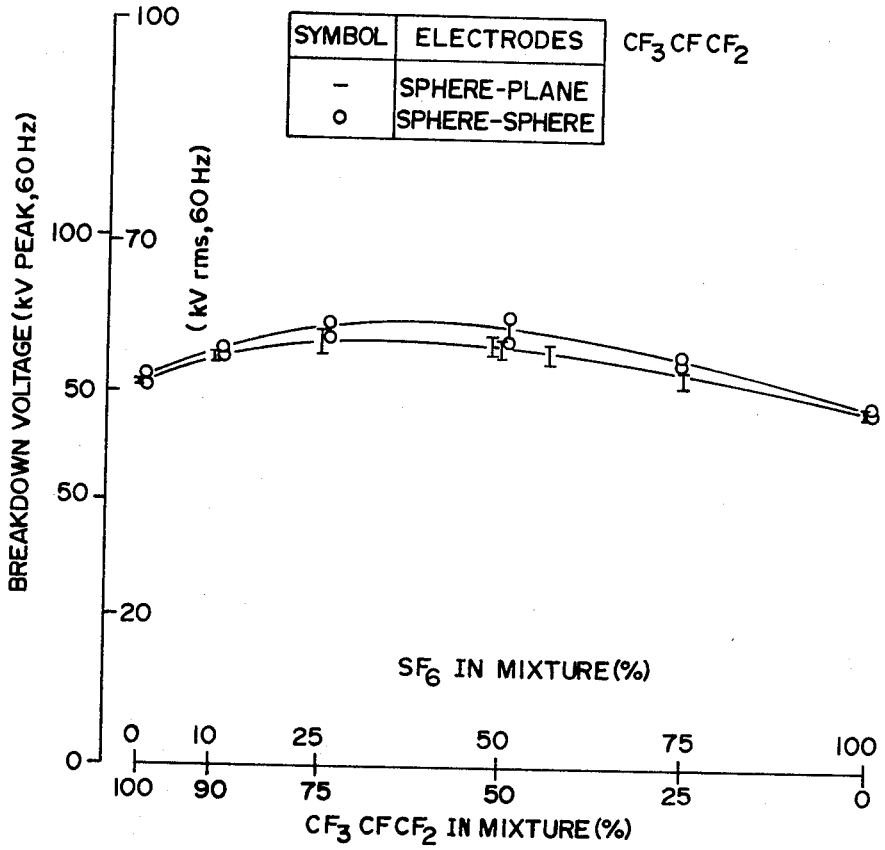
FIG. 1 is a graph of breakdown strength versus composition of a binary mixture of $SF_6$. and $CF_3CFCF_2$.

Referring to the graph of FIG. 1, the breakdown voltages of the binary mixture $CF_3CFCF_2$ and $SF_6$ are plotted against breakdown voltage and measured in KV peak, 60 Hz. The strengths are measured in two quasi-uniform 5 mm. gaps at 0.15 MPa. The ratio of (peak field strength)/(average field strength) is 1.033 for the sphere-sphere case and 1.069 for the sphere-plane electrode system. These ratios were determined using a charge simulation computer program in each instance.

Referring again to FIG. 1, the maximum field in the sphere-plane system was 3.3% higher than the mean field while for the sphere-sphere system, it was 6.9% higher. The difference between the breakdown voltages for each gas alone in the two fields configurations correspond closely to the difference in the field factors in the two configurations. For the mixtures, the difference is much greater, and for both electrode configurations, the breakdown voltage is higher than for either gas alone. Also, the more uniform field yielded the higher strength suggesting that a completely uniform field would insure the effect to an even greater degree.

The form of the curves illustrated in FIG. 1 cannot be explained on the basis of linear addition of net ionization coefficients. Thus, there is a synergistic effect on the addition of the both of the electric strengths of the two gases, and in the addition of the net ionization coefficients. A linear addition of net ionization coefficients of the gases in a binary mixture would always result in an electric strength for the mixture intermediate between the two gases alone. This is clearly not the case in FIG. 1.

One possible theory for this phenomenon is that the mixtures have an electron energy distribution which is modified by the mixture in a way favorable for high electric strength compared with the case for either gas alone.

Figure 3:
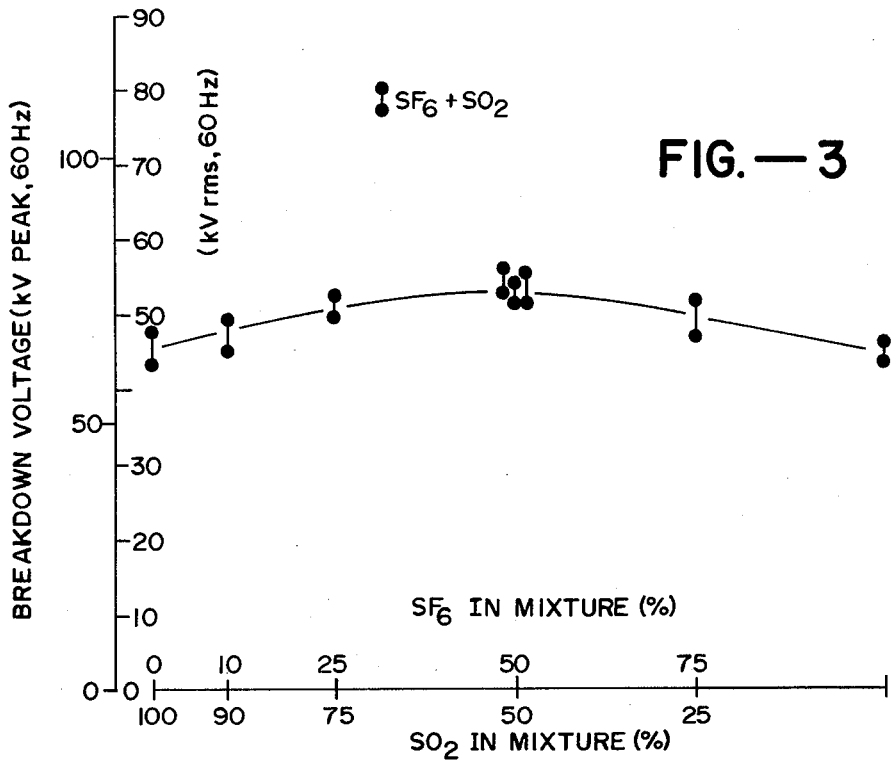
FIG. 3 is a graph of breakdown strength versus composition of a binary mixture of $SO_2$ and $SF_6$.
Figure 2:
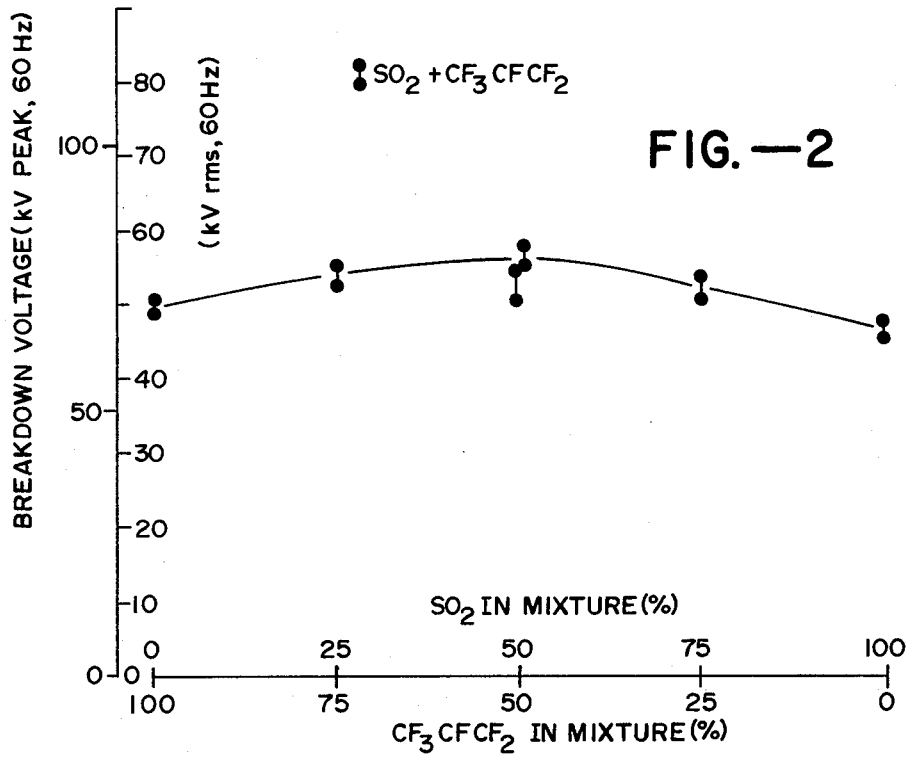
FIG. 2 is a graph of breakdown strength versus composition of a binary mixture of $SO_2$ and $CF_3CFCF_2$.

Referring to FIGS. 2 and 3, the same phenomenon is illustrated for binary mixtures of $SO_2$ and $CF_3CFCF_2$, and $SO_2$ and $SF_6$, respectively, for a sphere-plane configuration only. The results of FIGS. 2 and 3 are particularly important in view of the economy of using $SO_2$ as a component of the binary gas mixture.

Some of the mixtures of FIGS. 2 and 3 deposited films on the electrode surfaces (possibly sulfur). Such measurements were made starting with newly cleaned electrode surfaces. Two of the three measurements in FIG. 2 were of equimolar (50/50) mixtures and taken immediately after the electrodes were cleaned. It is evident that the value of the maximum of the curve is repeatable. Similarly, the measurements with 56% $SF_6$ and 44% $CF_3CFCF_2$ in FIG. 2 were taken and later the remainder of the measurements were taken. The higher of the two sets of measurements for the 50/50 mixtures were taken after cleaning the electrodes, a slight yellow-brown deposit being present when the lower results were obtained.

The proportions of the two gases in the binary mixtures of the present invention can be varied to a considerable extent while still retaining a dielectric strength. For maximum advantage, the mixtures should include at least 25% of each component. For $SO_2$ and $CF_3CFCF_2$ (FIG. 1) and $SO_2$ and $SF_6$ (FIG. 3), the optimum mixtures center around 50% of each component and so the strongest mixtures include at least 40% of each. For $SF_6$ and $CF_3CFCF_2$ (FIG. 2) the strongest mixture is 25 to 50% $SF_6$ and 75 to 50% $CF_3CFCF_2$. If desired, a minor amount of a third gas could be included in the above binary mixtures.

What is claimed is:

1. A dielectric gas mixture comprising a binary pair of gases selected from the group consisting of (a) $SF_6$ and $CF_3CFCF_2$, (b) $SO_2$ and $CF_3CFCF_2$, and (c) $SO_2$ and $SF_6$.

2. The gas mixture of claim 1 characterized by a higher composite dielectric strength than either component of the binary pair.

3. The gas mixture of claim 1 including at least 25 mole % of each component of the binary pair.

4. The gas mixture of claim 1 in which said binary pair is $SF_6$ and $CF_3CFCF_2$.

5. The gas mixture of claim 1 in which said binary pair is $SO_2$ and $CF_3CFCF_2$.

6. The gas mixture of claim 1 in which said binary pair is $SO_2$ and $SF_6$.

7. A method for insulating the conductor of an electrical apparatus comprising the step of disposing a dielectric gas mixture adjacent said conductor while it carries an electric current, said gas mixture comprising a binary pair of gases selected from the group consisting of (a) $SF_6$ and $CF_3CFCF_2$, (b) $SO_2$ and $CF_3CFCF_2$, and (c) $SO_2$ and $SF_6$.

8. Electric equipment comprising an electrical conductor and a contained dielectric gas mixture adjacent said conductor, said gas mixture comprising a binary pair of gases selected from the group consisting of (a) $SF_6$ and $CF_3CFCF_2$, (b) $SO_2$ and $CF_3CFCF_2$, and (c) $SO_2$ and $SF_6$.

* * * * *